US007306499B2

(12) United States Patent
Okuyama

(10) Patent No.: US 7,306,499 B2
(45) Date of Patent: Dec. 11, 2007

(54) WATERCRAFT

(75) Inventor: Takashi Okuyama, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 54 days.

(21) Appl. No.: 11/135,959

(22) Filed: May 24, 2005

(65) Prior Publication Data

US 2005/0266743 A1 Dec. 1, 2005

(30) Foreign Application Priority Data

May 25, 2004 (JP) ..... 2004-154129

(51) Int. Cl.
*B60W 10/04* (2006.01)

(52) U.S. Cl. ..... 440/87

(58) Field of Classification Search ..... 440/87
See application file for complete search history.

(56) References Cited

U.S. PATENT DOCUMENTS 1,843,272 A * 2/1932 Evinrude ..... 440/2
2,204,265 A * 6/1940 Wentzel ..... 477/173
5,103,946 A * 4/1992 Masters et al. ..... 477/209
6,612,882 B2 * 9/2003 Shidara et al. ..... 440/1
2004/0029461 A1 2/2004 Shomura

FOREIGN PATENT DOCUMENTS

JP 2004-068704 3/2004

* cited by examiner

*Primary Examiner*—Stephen Avila
(74) *Attorney, Agent, or Firm*—Knobbe, Martens, Olson & Bear, LLP

(57) ABSTRACT

An watercraft can include a steering unit including a steering member and a steering shaft, a propulsion system, a power output control mechanism for controlling the power output to the engine, a manually operated power output adjusting mechanism for adjusting the power output control mechanism, the power output adjusting mechanism being mounted on the steering wheel unit.

19 Claims, 10 Drawing Sheets

WATERCRAFT

PRIORITY INFORMATION

This application is based on and claims priority under 35 U.S.C. §119 to Japanese Patent Application No. 2004-154129, filed on May 25, 2004, the entire contents of which is hereby expressly incorporated by reference herein.

BACKGROUND OF THE INVENTIONS

1. Field of the Inventions

The present inventions relate to a watercraft having marine propulsion units such as outboard motors and stem drives. More specifically, these inventions relate to an arrangement for a power control device for marine vehicles.

2. Description of the Related Art

When operators run a watercraft having a marine propulsion unit such as outboard motors and stem drives (hereafter inclusively referred to as "outboard motor"), they adjust the opening degree of a throttle valve disposed in the engine intake system to control the power output of the engine. This allows the operator to control the speed, acceleration, and deceleration of the watercraft.

The throttle valve opening typically is adjusted by a main control lever that is provided on the watercraft body and operated by a watercraft operator. As the main control lever is operated, the throttle valve is opened or closed via a mechanical push-pull wire. Where an electronic throttle control is used, a motor for the throttle valve is driven via an electric cable or a wireless system.

The main control lever also can also serve as a gear shift lever. For instance, when the main control lever is tilted forwardly by the operator, the watercraft runs forwardly. When it is tilted rearwardly, the watercraft runs in reverse. When it is at the center position, the transmission is in neutral. Further, the throttle valve moves between the opened and closed positions in response to the forward and rearward tilt angle of the main control lever.

While adjusting the throttle by the main control lever, the operator might also need to steer the watercraft by turning the steering wheel. Since the main control lever is typically provided at the side of the operator's seat, the operator must remove one hand from the steering wheel, and reach out substantially for adjusting the throttle valve opening. In the choppy water or under the high wind, such operation becomes more difficult because the operators must adjust the throttle valve opening frequently. Additionally, the operator may need to turn the rudder against the beam sea and the beam wind, taking into account the timing of swells and the side drift of the watercraft due to the high wind while simultaneously adjusting the throttle position with the main lever.

Japanese Patent Publication JP-A-2004-68704 describes an outboard motor in which the throttle valve opening can be adjusted without the need for multiple steps of control. The outboard motor has an electric air valve that increases or decreases the intake air amount into the engine via a system that is independent of the throttle valve. A control section including an actuator for controlling the opening of the electric air control valve. An engine speed adjusting section is provided on the watercraft body by which the operator can directly input the signals to the control section mentioned above for increasing or decreasing the intake air amount. However, the outboard motor described in the JP-A-2004-68704 publication has the throttle lever provided on the remote-control box located at the side of operator's seat.

Thus the operator must remove one hand substantially away from the steering wheel to adjust the throttle valve opening, as was explained above.

The aforementioned engine speed adjusting section for controlling the opening of air control valve independent of the throttle valve may be provided on the steering wheel. However, the amount of air adjustable by the air control valve is smaller than the amount of intake air into the engine through the throttle valve. This is used for the fine tuning of the throttle valve opening. Therefore, operation by the throttle lever is still required when the engine speed has to be changed to a larger extent. The operation can be all the more complicated when the throttle lever is operated in conjunction with the engine speed adjusting section provided on the steering wheel for fine-tuning.

SUMMARY OF THE INVENTION

An aspect of at least one of the embodiments disclosed herein includes the realization that it is inconvenient for operators of watercraft to move their hands of the steering wheel to adjust the power output of the engine. Further, it has been realized that by providing a power output control device closer to the steering wheel such that an operator can adjust the power output of the engine, and preferably adjust the power output of the engine between generally the minimum power output (e.g. idle operation) and the approximate maximum power output without taking a hand off of the steering wheel.

Thus, in accordance with an embodiment, a watercraft comprises a steering unit including a steering wheel and a steering wheel shaft. A watercraft propulsion system is mounted at a stem of the watercraft. An intake air amount control mechanism is also provide for controlling the amount of air taken into an engine driving the watercraft propulsion system. Additionally, the watercraft can include a manually operated intake air amount adjusting means for adjusting the operation of the intake air amount control mechanism, wherein the intake air amount adjusting means is mounted on the steering wheel unit.

In accordance with another embodiment, a watercraft comprises a steering unit including a steering wheel and a steering wheel shaft. A watercraft propulsion system can be mounted at a stem of the watercraft. A power output control mechanism can be configured to control the power output of an engine driving the watercraft propulsion system. Additionally, the watercraft can include a manually operated power output adjusting means for adjusting the operation of the power output control mechanism, wherein the power output adjusting means is mounted on the steering wheel unit.

In accordance with yet another embodiment, a watercraft comprises a steering unit including a steering wheel and a steering wheel shaft. A watercraft propulsion system can be mounted at a stem of the watercraft. A power output control mechanism can be configured to control the power output of an engine driving the watercraft propulsion system. Additionally, the watercraft can include a manually operated power output adjustment device configured to adjust the operation of the power output control mechanism, wherein the power output adjusting device is mounted on the steering wheel unit.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENT

Figure 1:
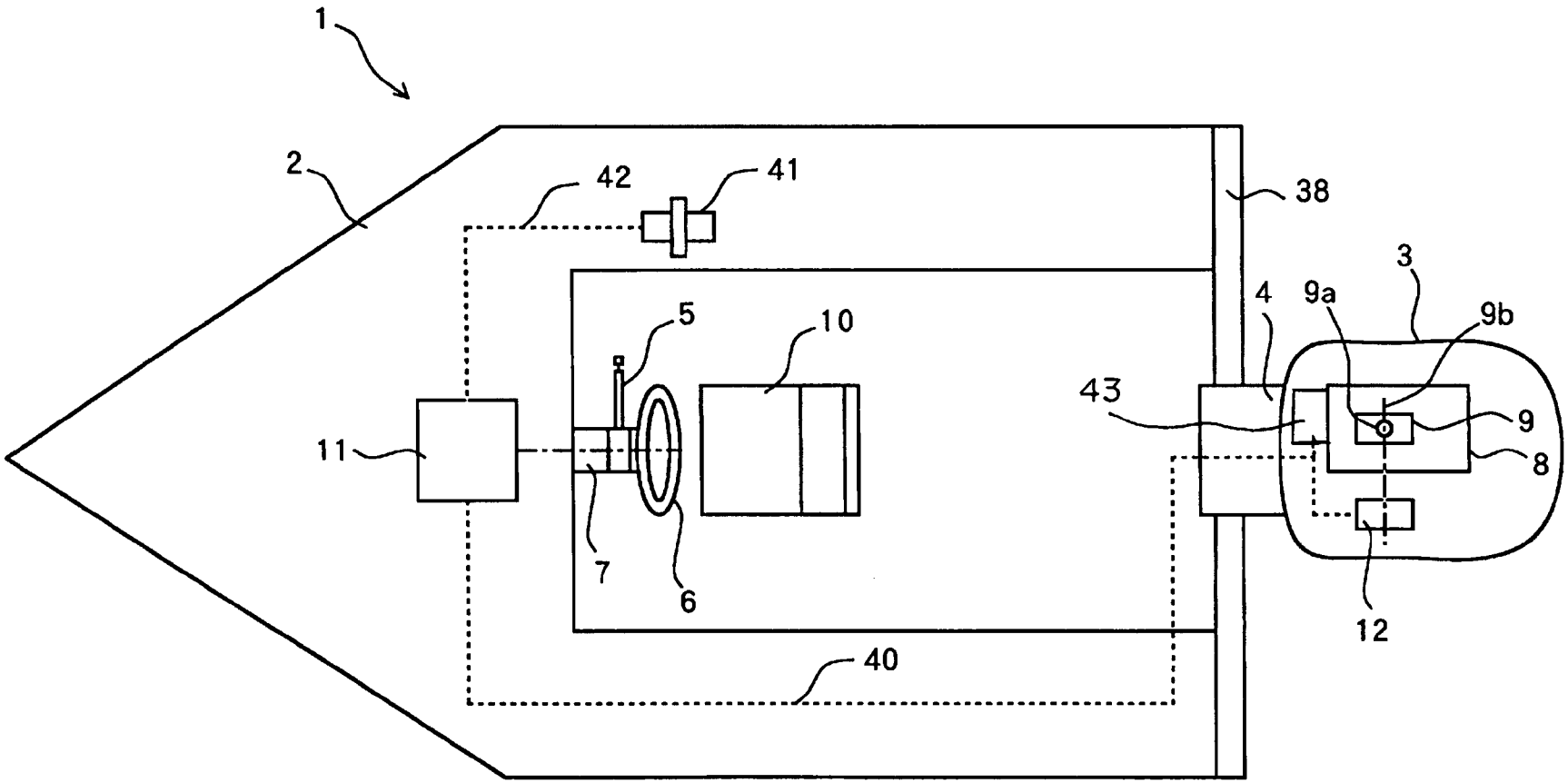
FIG. 1 is a schematic top view of a watercraft having a watercraft steering wheel according to this invention.

FIG. 1 is a schematic top plan view of a watercraft 1 having a watercraft steering wheel with which the present embodiments are applicable. The embodiments disclosed herein are described in the context of a marine propulsion system of a watercraft because these embodiments have particular utility in this context. However, the embodiments and inventions herein can also be applied to other marine vessels, such as personal watercraft and small jet boats, as well as other vehicles.

With reference to FIG. 1, the watercraft 1 is provided with a watercraft body 2 and an outboard motor 3 mounted onto a transom plate 38 of the watercraft body 2 via a clamp bracket 4. The outboard motor 3 includes an engine 8. A throttle body 9 (or a carburetor) is provided in an intake system of the engine 8 to control the rotational speed and the torque of the engine 8 by adjusting the amount of intake air to the engine 8.

The throttle body 9 can include a throttle valve 9*a*. The Throttle valve 9*a* can be manually controlled by the operator, or it can be electronically controlled with, for example, an electric actuator. In the illustrated embodiment, the throttle valve 9*a* is electronically controlled.

A valve shaft 9*b* of the throttle valve 9*a* can be connected to a motor. Such a motor can be mounted directly to the throttle body 9 or it can be mounted remotely from the throttle body 9 with a mechanical linkage connecting the throttle body 9 and the motor. In the illustrated embodiment, the valve shaft 9*b* is connected to a motor 12. The motor 12 can be configured to move the throttle valve 9*a* between opened and closed positions.

A steering wheel 6 can be provided in front of an operator's seat 10 of the watercraft body 2 for steering the watercraft 1. The steering wheel 6 is mounted on the watercraft body 2 via a steering wheel shaft 7.

In accordance with an embodiment, the steering wheel shaft 7 is provided with a hand control lever 5 for adjusting the opening of the throttle valve 9*a*. The lever 5 is merely one example of an input device that can be used; other types of devices can also be used. In the illustrated embodiment, the lever 5 is a stick-shaped lever.

The lever 5 is configured to allow watercraft operators to control the running speed, acceleration, deceleration, etc. of the watercraft 1 by operating the hand control lever 5 to adjust the opening of the throttle valve 9*a*, in other words, by controlling the throttle valve 9*a* movement to regulate the engine running conditions. Further, the lever 5 is arranged to allow an operator to adjust the power output of the engine 8 between generally the minimum power output (e.g. idle speed operation) and approximately the maximum power output (e.g. "wide open throttle"). Further, in some embodiments, the engine 8 can include an auxiliary intake air supply system. For example, such systems are well known in the art for adjusting the power output of the engine within a narrower range of the maximum range of power output of marine and other types of engines. Thus, by configuring the lever 5 to operate the throttle valve 9*a*, an operator can adjust the power output of the engine between the approximate minimum power output (i.e., idle speed operation) and approximately the maximum power output (e.g., "wide open throttle"), even though the auxiliary intake air supply system may be configured to allow additional intake air for additional power output when the throttle valve 9*a* is in its maximum opening position, or to further reduce the intake air amounts when the throttle valve 9*a* is at the minimum opening position.

Operation of the hand control lever 5 can be transmitted to the motor 12 by way of a control circuit 11 equipped on the watercraft body 2 through wire or by a wireless system (via a signal cable 40 in the case of FIG. 1) for adjusting the opening of the throttle valve 9*a*. However, other types of systems can also be used to transmit or translate movements of the lever 5 into movements of the throttle valve 9*a* or any other device that can control the power output of the engine 8.

Further, a main control lever 41 can be provided on the watercraft 1 at the side of the operator's seat, or at other locations. The main control lever 41 can be used for the shifting and the adjustment of the throttle valve 9*a* opening (accelerating operation).

The main control lever 41 can be configured such that the transmission of the outboard motor 3 is in neutral when the main control lever 41 is in its center position. Additionally, the transmission can be shifted into forward when the lever is tilted forwardly by a predetermined amount away from its center position. Similarly, the transmission can be shifted into reverse when the lever is tilted rearwardly beyond a predetermined amount.

When the lever is tilted further forwardly after the transmission has shifted to forward, the throttle valve 9*a* opens in response to the forward titling motion, until it reaches the full open throttle position. When the lever is tilted further rearwardly after the transmission has shifted to reverse, the throttle valve 9*a* also opens in response to the rearward titling motion, until it reaches the full open throttle position. In this way, the engine acceleration is achieved by controlling the opening and closing of the throttle valve 9*a* in both forward and reverse operations. The main control lever 41 can be connected to the control circuit 11 by way of a signal cable 42. The main control lever 41 and the hand control lever 5 can be activated selectively as described below with reference to FIG. 6.

Shifting into forward, reverse, or neutral can be implemented by an electric shifting mechanism 43 provided on the outboard motor 3, that is configured to serve as a forward-neutral-reverse transmission. Such transmissions have long been used in the outboard motor and stern drive arts, and thus, are not described in further detail.

As described above, the above-noted arrangements allow the watercraft operator to use the hand control lever 5 as the means for controlling the power output of the engine. In the illustrated embodiments, the lever 5 provided on the steering wheel shaft 7 is configured to control the opening and closing the throttle valve 9*a* which controls the intake air amount and thus the power output of the engine. Thus, watercraft operators using such an arrangement can control the running speed, acceleration, or deceleration of the watercraft 1 without the need for reaching out their hands to the position away from the steering wheel 6. Instead, operators can keep hands on the steering wheel 6. This is useful for improving the operability of watercraft.

For instance, the steering operation by turning the steering wheel and the throttle opening control can be performed simultaneously and more easily even when turning the rudder against the beam sea and the beam wind. The power output control mechanism is not limited to mechanisms for limiting intake air amounts, but can also be control mechanisms for controlling other aspects of engine operation. Further, when a mechanism for limiting the intake air amount is used, it does not have to be a throttle valve, but it can also be a mechanism controlling the opening and closing timing of the engine intake valves. These types of systems are used on throttleless engines.

FIGS. 2 through 8 are illustrations for explaining exemplary but non-limiting functions of the watercraft steering wheel. In one of the examples shown in FIG. 2(A), the throttle valve 9*a* (FIG. 1) opens by moving the hand control lever 5 upward (in the direction of arrow "U"), and closes the throttle valve 9*a* by moving the hand control lever 5 downward (in the direction of arrow "D"). In other words, the motor 12 (FIG. 1) rotates in the direction of opening the throttle valve when the lever 5 is moved upward, and when the lever 5 is moved downward, the motor 12 rotates in the direction of closing the throttle valve. As the lever 5 is returned to the center position (position C), the motor 12 stops, and the throttle valve is sustained at the opening position it took when the motor was stopped.

Figure 2:
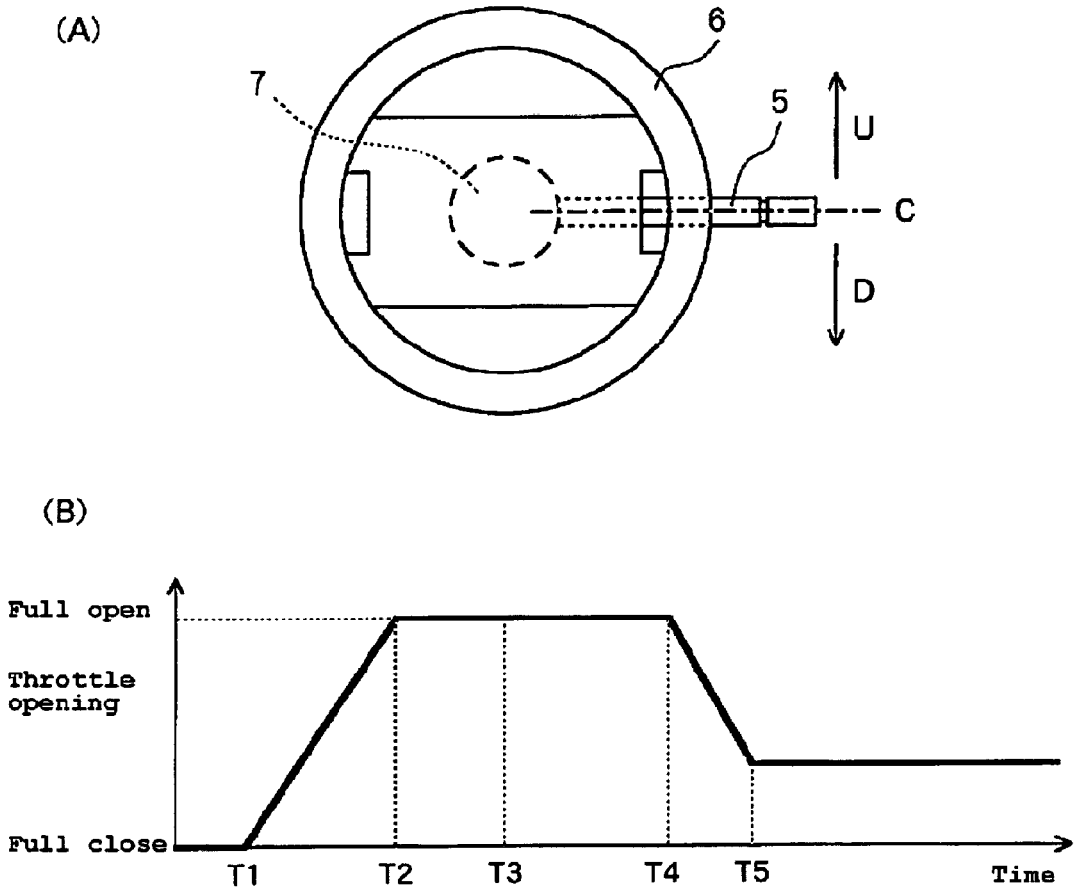
FIG. 2 is an illustration for explaining functions of the watercraft steering wheel according to this invention.
Figure 3:
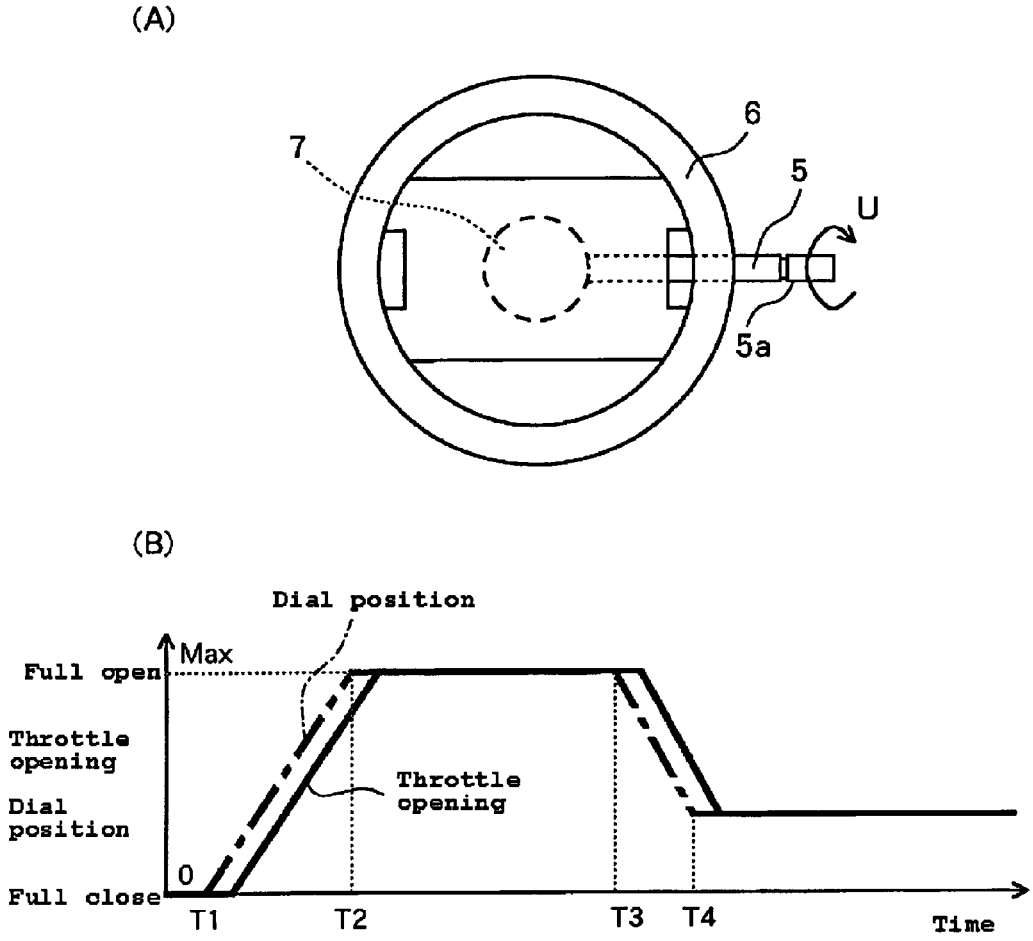
FIG. 3 is an illustration for explaining functions of the watercraft steering wheel according to this invention.

The chart in FIG. 2 (B) shows the throttle opening relative to the time sequence when the hand control lever 5 is used for the watercraft operation. The hand control lever 5 is moved upward while the throttle is in the fully closed (idle speed) position (T1). Then, the throttle opens gradually. As the hand control lever 5 is returned to the center position, the throttle opening is sustained at the position it took before the hand control lever 5 is returned to the center position. When the hand control lever 5 is held in an elevated position, the throttle valve 9*a* eventually reaches to the full open throttle position (T2).

If the hand control lever 5 is kept at the raised position, the amount of intake air of full open throttle is maintained, since the throttle valve cannot be opened any wider. As the lever 5 is returned to the center position (position C) (T3), the motor stops, and the throttle valve 9*a* is sustained at the full open throttle position. The watercraft operator moves the hand control lever 5 downward to close the throttle valve 9*a*. As the hand control lever 5 is moved downward, the motor 12 rotates in the direction of closing the throttle valve gradually, resulting in the reduction of intake air amount. As the hand control lever 5 is returned to the center position on the way (T5), the motor stops to sustain the throttle valve 9*a* opening at that point.

In one of the examples shown in FIG. 3(A), an end portion 5*a* of the hand control lever 5 is constituted as a rotatable dial. In these embodiments, the end portion 5*a* is rotated to adjust the throttle valve opening. In other words, the dial is devised so that it is rotatable within the certain angle range (that is, from "zero" or "idle" position to the maximum rotatable position corresponding to "full throttle" or "wide open throttle (WOT)").

The rotational angle range of the end portion 5*a* is associated with the throttle valve openings from fully closed position to full open throttle position. For instance, when the dial is rotated from the zero position (throttle valve fully closed) to the upper position (in the direction of "U"), the throttle valve opens corresponding to the degree of dial rotation. When the dial is rotated to the farthest position, the throttle valve reaches to the full open throttle. In this way, the throttle valve opening may be adjusted in response to the rotational angle of the dial. In some embodiments, upward and downward rotation of the lever end portion 5*a* may also be utilized for adjusting the throttle opening, in accordance with the up and down operation of the hand control lever 5 described above regarding the example shown in FIG. 2.

As an example of such arrangement, the end portion 5*a* can be constructed so that the throttle valve 9*a* opens as the end portion 5*a* is rotated upward from the center position, and it closes as the end portion 5*a* is rotated downward. When the end portion 5*a* is returned to the center position, the valve opening stops at the position it took before the end portion 5*a* is returned to the center position, as explained above with reference to the embodiments of FIG. 2.

The chart in FIG. 3(B) shows the throttle opening relative to the time sequence when the dial type operating device is used for the watercraft operation. The end portion 5*a* is rotated upward (in the direction of arrow "U") while the throttle is in the fully closed position (dial at "zero" position) (T1). Then, the throttle valve opens gradually (as represented by the solid line in the chart) in proportion to the rotation angle of the end portion 5*a* (as represented by the dashed line in the chart). When the end portion 5*a* is rotated to the full extent (T2), the throttle opens to the full open throttle position accordingly. Rotating the end portion 5*a* in the reverse direction toward the original position will decrease the amount of intake air (T3). As the end portion 5*a* is rotated in reverse, the throttle valve closes gradually so that the throttle opening is adjusted in response to the rotation angle of the end portion 5*a*.

Figure 4:
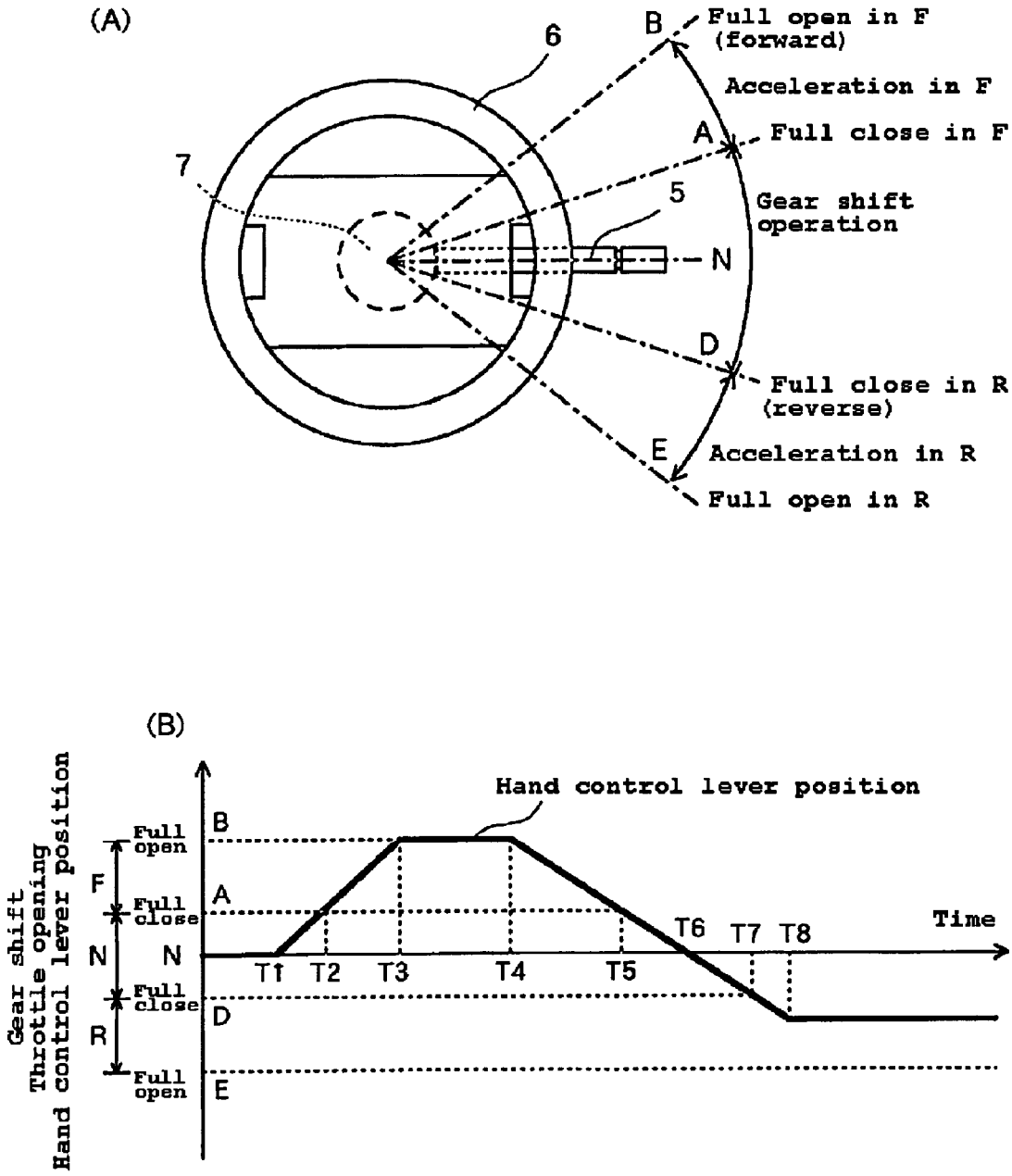
FIG. 4 is an illustration for explaining functions of the watercraft steering wheel according to this invention.

FIG. 4 shows an example in which the lever 5 is also used to activate the shifting mechanism. As shown in FIG. 4(A), the hand control lever 5 controls gear shifting within the range from A to D. "N" represents the neutral position. As the lever 5 is pushed upward, the transmission shifts into forward at the position "A". The throttle is fully closed (idling operation) when the lever is at the position "A". When the lever is in the range from A to B, the throttle valve 9*a* is between the fully closed position and the fully open position, and thus, the watercraft 1 will accelerate forwardly.

The position "B" corresponds to a fully open throttle position. The position of the lever 5 within the range from A to B determines the throttle valve opening. Thus, by moving the lever 5 within the range from A to B, the throttle valve 9*a* is opened and closed accordingly to achieve the corresponding power output from the engine 8.

On the other hand, when the hand control lever 5 is tilted downward from the neutral position (N), the transmission gear is shifted into reverse at position "D". The throttle is fully closed (idling operation) when the lever is at the position "D". When the lever is in the range from D to E, the engine is in the reverse accelerating operation. The position "E" corresponds to the full open throttle.

FIG. 4(B) illustrates exemplary relationships between the shifting position and the throttle opening in relation to the operating positions of the hand control lever 5. When the hand control lever 5 is moved upward from the neutral position (N) (T1), the throttle valve 9*a* is fully closed (idling operation). As the hand control lever 5 reaches position "A" (T2), the transmission is shifted into forward (F) (the throttle valve is kept fully-closed to this position).

Once the hand control lever 5 is tilted upward further from position "A", the throttle valve 9*a* opens gradually until it reaches to the full open throttle position at position "B" (T3). As the hand control lever 5 is returned from position "B" (T4), the throttle valve 9*a* closes gradually until it returns to the position "A" at which point the throttle valve is fully closed (T5). Once the hand control lever 5 is moved downward further beyond the position "A", the transmission is disengaged from the forward shifting position (F), and moves into the neutral position (N). When the hand control lever 5 reaches the horizontal neutral position (T6), and is moved further down to reach the position "D" (T7), the transmission is shifted into the reverse gear (R).

While the hand control lever 5 is located in the range from T5 to T7, the transmission is in neutral and the throttle valve is fully closed. When the hand control lever 5 is tilted further downward from the position "D" (T7), the throttle valve again opens gradually. The hand control lever 5 at the position "E" corresponds to the full open throttle in reverse. If the hand control lever 5 is held at some point between the positions "D" and "E" (T8), the throttle valve movement stops keeping the throttle opening at the time of lever stoppage. Operation signals of the gear shifts described above can be transmitted to the electric shifting mechanism 43 (FIG. 1) by way of the signal cable 40 to activate the gear shift.

Figure 5:
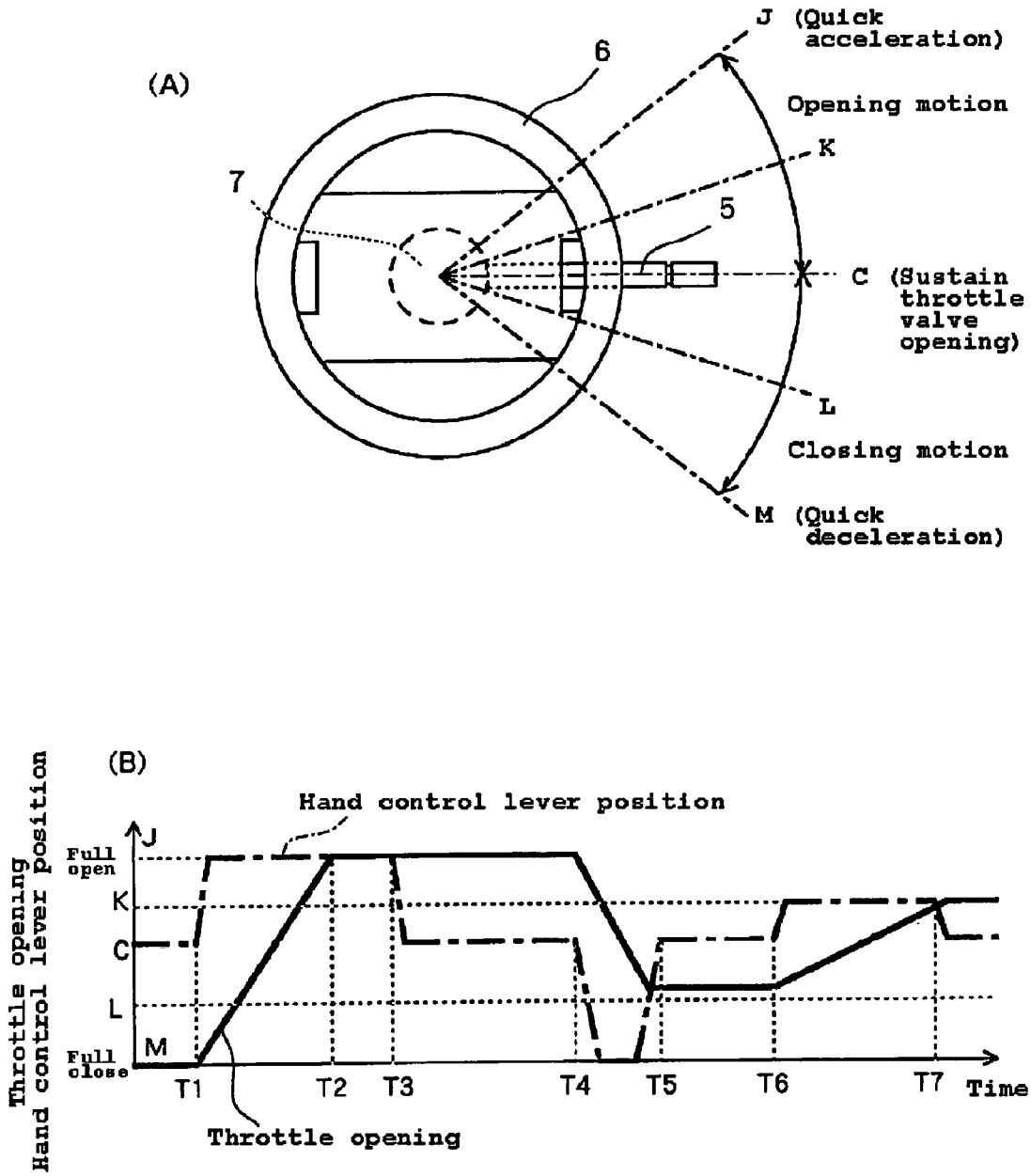
FIG. 5 is an illustration for explaining functions of the watercraft steering wheel according to this invention.

FIG. 5 is an example of hand control lever 5 provided with variable throttle opening speed functionality. The example in FIG. 5 has a structure that the upward movement of the hand control lever 5 from the center position "C" opens the throttle valve, while the downward movement of the hand control lever 5 from the position "C" closes the throttle valve, similar to the aforementioned example in FIG. 2. Having such a structure, the opening and closing speed of the throttle valve in the example shown in FIG. 5 varies in accordance with the distance that the hand control lever 5 has been moved from the center position (that is the tilting angle of the lever).

When the hand control lever 5 is moved substantially upward from the position "C" to the position "J", the throttle valve 9*a* opens quickly (quick acceleration). When the hand control lever 5 is moved to the intermediate position "K" and is held there, the throttle valve 9*a* opens slowly in proportionate to the tilting angle of the moved lever 5. Once the throttle valve 9*a* has been opened to the desired opening position, moving the hand control lever 5 to the center position will cause the motor to stop, and the throttle valve opening at that time is maintained.

To open the throttle valve 9*a* further from this state, the hand control lever 5 is moved upward again to drive the motor in the direction of opening the throttle valve 9*a*. To close the throttle valve 9*a* from this state, the hand control lever 5 is tilted downward from the position "C" to drive the motor in the direction of closing the throttle valve 9*a*.

Likewise, in the throttle valve closing operation, the closing speed of the throttle valve varies in accordance with the tilting angle of the hand control lever 5 relative to the center position. The throttle valve opening changes most quickly in the closing direction when the hand control lever 5 is in the position "H" having the maximum tilting angle (quick deceleration).

When the hand control lever 5 is stopped at the intermediate position "L", the throttle valve 9*a* closes slowly in proportionate to the tilting angle of the moved lever 5. Once the throttle valve has been closed to the desired opening position, moving the hand control lever 5 to the center position will cause the motor to stop, and the throttle valve opening at that time is maintained. With such variable throttle opening/closing speed functionality based on the tilting angle of the hand control lever 5, the throttle opening/closing speed can be varied in the stepless manner, or can be changed in multiple steps, i.e, a plurality of predetermined speeds.

The chart in FIG. 5(B) shows the throttle opening relative to the time sequence when the hand control lever 5 is used for the watercraft operation. The hand control lever 5 can be moved upward from the center position (C) to the uppermost position (J) (T1) (as represented by the dashed line in the chart). In response to this movement, the throttle valve 9*a* opens to the full open throttle position at the maximum speed (T2) (as represented by the solid line in the chart). This means that the throttle valve 9*a* opens at the highest speed when the hand control lever 5 is raised to the uppermost position (J).

Then, the hand control lever 5 is returned to the position "C" (T3). Taking this action, the throttle valve 9*a* is maintained at full open throttle. Subsequently, as the hand control lever 5 is pushed down to the lowermost position (M) (T4), the throttle valve 9*a* starts its closing motion at the highest speed. Once the throttle valve opening achieves the desired position, the operator can return the hand control lever 5 to the position "C" (T5). Taking this action, the motor stops and the throttle valve opening at that time is maintained.

Moving the hand control lever 5 slightly upward (to the position "K", for instance) (T6) will result in the slowly opening throttle valve 9*a*. Once the throttle valve opening reaches the desired position, the hand control lever 5 can be returned to the position "C" (T7). Then, the motor stops, thereby keeping the current throttle valve opening, thus the throttle valve 9*a* it is maintained at the desired position.

Figure 6:
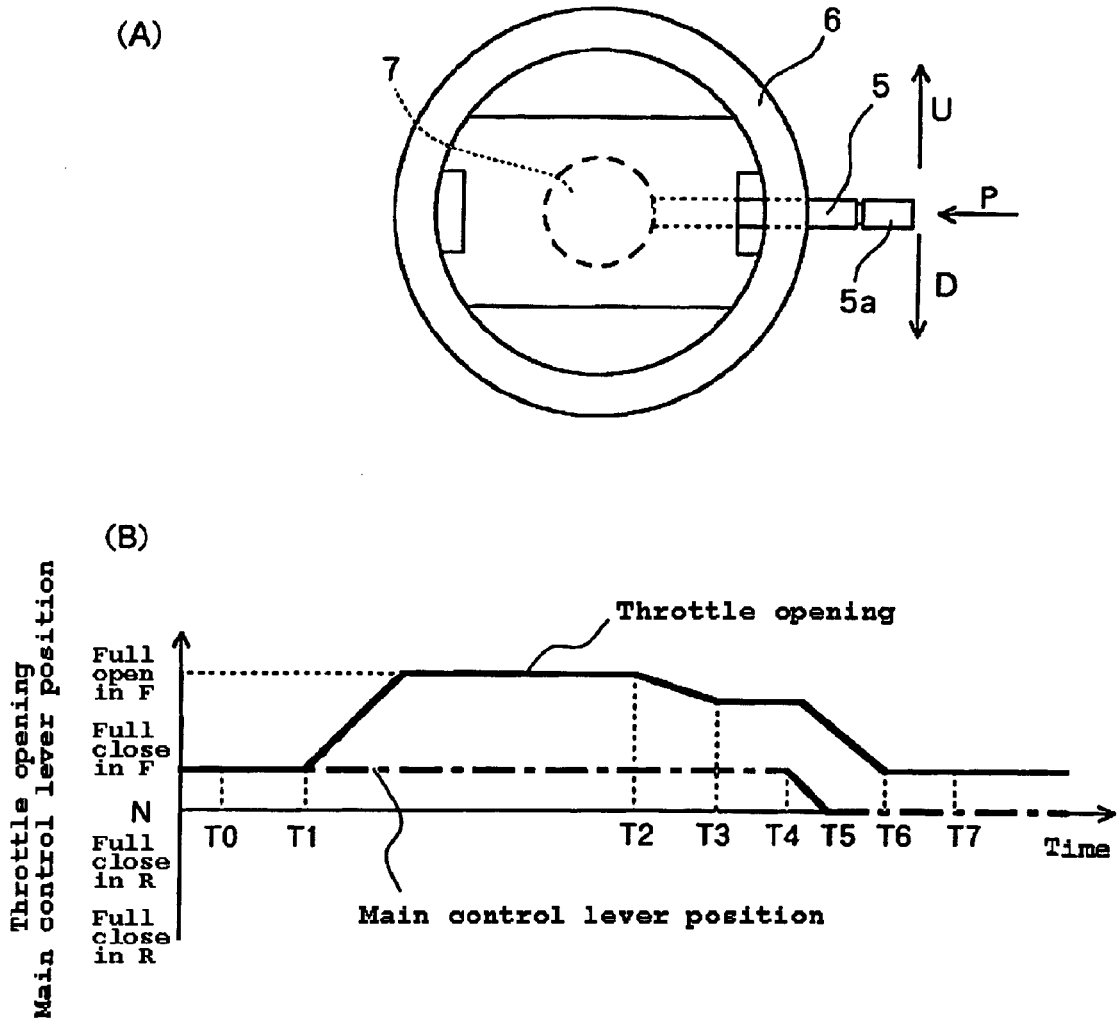
FIG. 6 is an illustration for explaining functions of the watercraft steering wheel according to this invention.

FIG. 6 shows another example in which the hand control lever 5 is configured to be movable in the vertical direction similar to the example in FIG. 2, with the end portion 5*a* being constituted as a selection switch between the hand control lever 5 and the main control lever 41 (FIG. 1). As shown in FIG. 1, the main control lever 41 is provided separately from the hand control lever 5 at the side of the operator's seat for adjusting the throttle valve opening.

Once the selection switch is turned ON by pushing the end portion 5*a* to the direction of arrow "P", the hand control lever 5 is selected so that the throttle valve motor is driven by the operation of the hand control lever 5. When the selection switch 5*a* is pushed again to change operation (or to turn it OFF), the main control lever 41 is selected so that the throttle valve motor is driven by the operation of the main control lever 41.

When they are not being chosen by the selection switch 5*a*, operation of the main control lever 41 or the hand control lever 5 would not cause any operating signal to be transmitted to the motor. In this way, the watercraft operator can choose to use either the hand control lever 5 or the main control lever 41 for the watercraft operation, depending on the operator's familiarity and preference, or depending on the watercraft operating conditions for leaving the shore, getting to the shore, and so on.

The chart in FIG. 6(B) shows the throttle opening relative to the time sequence when the hand control lever 5 is used for the watercraft operation. In this scenario, the selection switch 5*a* is used to choose the hand control lever (T0). This allows the watercraft operation using the hand control lever 5.

Moving the hand control lever 5 upwardly in this condition (T1), the throttle valve 9*a* opens gradually. It opens to the full open throttle position when the hand control lever 5 is kept at such a raised position. Then, the full open throttle position is maintained by returning the hand control lever 5 to the center position.

Further, as the hand control lever 5 is pushed downwardly from the center position, the throttle valve 9*a* starts its closing motion (T2). The hand control lever 5 is returned to the center position, once the throttle valve 9*a* has closed to the given opening position. This will maintain the throttle opening at the current position.

Then, the main control lever 41 is selected by pushing the selection switch 5*a* (T4). This allows the throttle opening adjustment using the main control lever 41. At this time, the main control lever 41 is in the position corresponding to the full close throttle position in forward shift. Thus the throttle valve 9*a* starts its closing motion.

Next, the main control lever 41 is shifted to the neutral position (N) from the previous forward shift (F) (T5). The throttle valve closing motion is sustained by this action until the throttle opening reaches to its full close position (T6). Subsequently, operations by the hand control lever 5, moving it upward at T7, for instance, will not cause any change in the throttle valve opening, since the main control lever 41 has been chosen by the selection switch.

Figure 7:
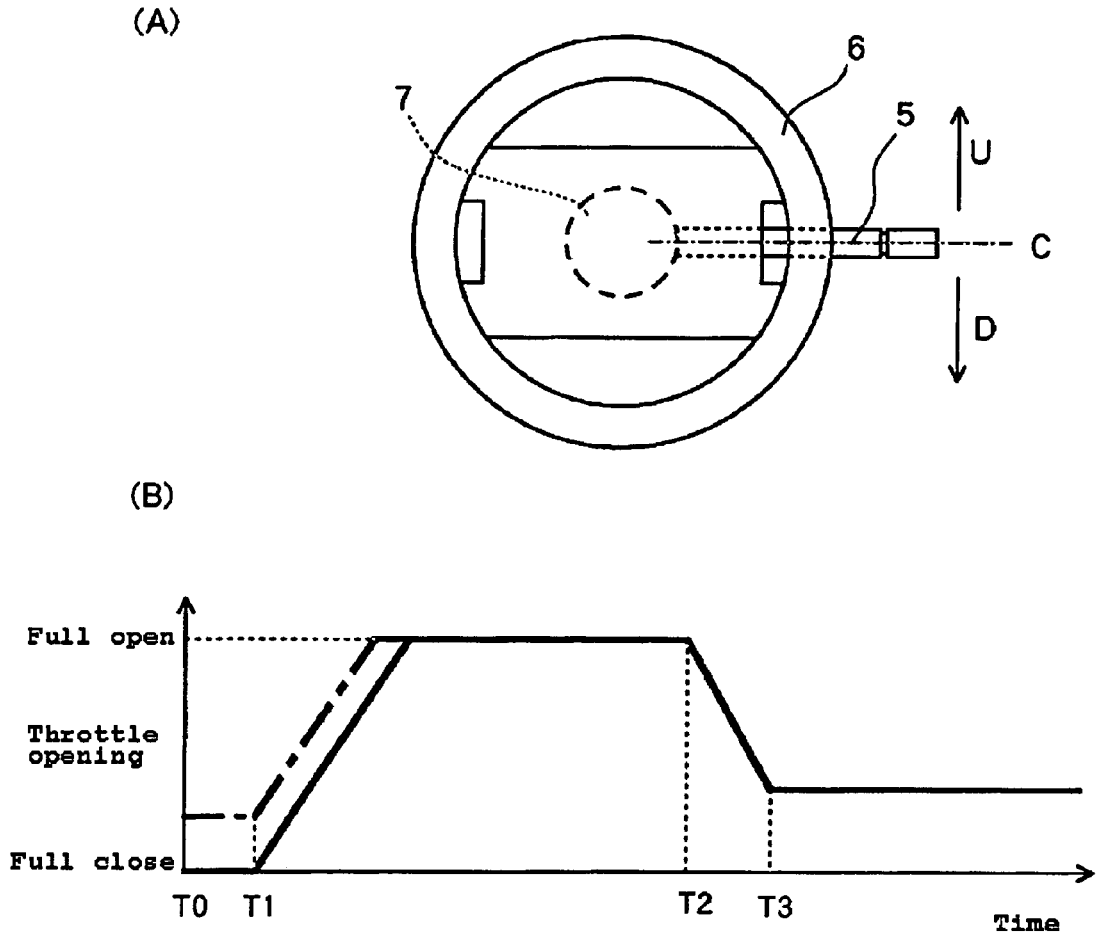
FIG. 7 is an illustration for explaining functions of the watercraft steering wheel according to this invention.

FIG. 7 shows the mechanism of hand control lever 5 in the case of multiple outboard motor installation. As shown in FIG. 7(A), and similar to the example shown in FIG. 2 above, the up (U) and down (D) operations of the hand control lever 5 causes the opening and closing motion of the throttle valve 9*a*. In some embodiments, the lever 5 can be used to simultaneously adjust the opening of each throttle valve 9*a* on each outboard motor. For example, each of the throttle valves 9*a* on each outboard motor can be moved in synchronicity.

When the hand control lever 5 is returned to the center position (C), the throttle valve motor stops sustaining the throttle valve opening at that time. In the example shown in FIG. 7, outboard motors of multiple installation are controlled by one common hand control lever 5 regarding their throttle valve opening. The main control lever 41 may be provided separately in this case so as to allow independent throttle valve control for each outboard motor.

The chart in FIG. 7(B) shows the throttle opening relative to the time sequence in the case of twin outboard motor installation. For instance, the hand control lever 5 is pushed upward (in the direction of arrow "U") (T1) while the throttle valve 9*a* on the starboard side outboard motor (as represented by the dashed line in the chart) is slightly open and the one on the port side outboard motor (as represented by the solid line in the chart) is in fully-closed position (T0). Then the throttle valves on both outboard motor opens gradually at the same speed. Keeping the lever 5 at the pushed-up position will maintain the throttle valve opening motions until they reach the full open throttle. Then, the hand control lever 5 is returned to the center position (C), and is pushed down further (in the direction of arrow "D"). This starts the throttle valve closing motion (T2). Once the throttle opening reaches the desired position, by returning the hand control lever 5 to the center position (C), the throttle valve opening on both outboard motors is kept at the desired position.

Figure 8:
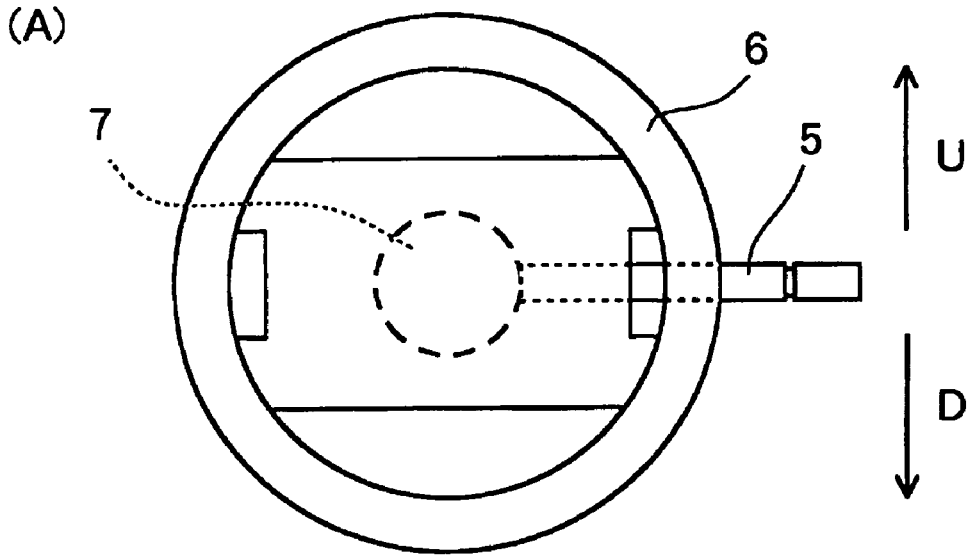
FIG. 8 is an illustration for explaining functions of the watercraft steering wheel according to this invention.
Figure 8:
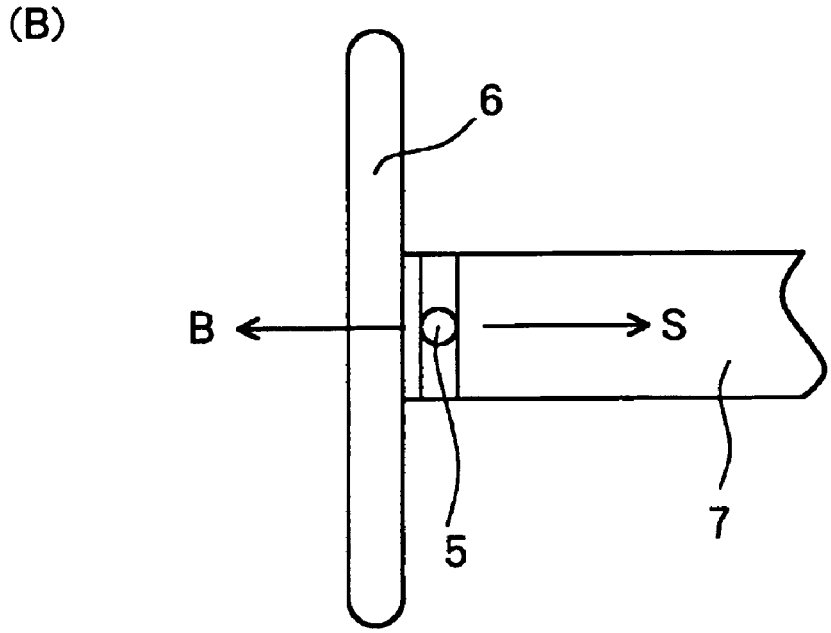

FIG. 8 shows the hand control lever 5 having a feature for controlling the trim and tilt mechanism. FIG. 8(A) is a front elevation view of the steering wheel 6, and FIG. 8 (B) is a side view of the steering wheel 6.

The throttle opening adjustment mechanism using the hand control lever 5 on the steering wheel 6, is similar to the example shown in FIG. 2. The example shown in FIG. 8 is further provided with the feature for controlling the trim and tilt mechanism.

For example, as shown in FIG. 8 (A), moving the hand control lever 5 up and down (in the direction of arrow "U" and "D") will cause the opening and closing motion of the throttle valve 9*a*. In addition, as shown in FIG. 8(B), moving the hand control lever 5 horizontally to forward and backward (in the direction of arrow "S" and "B") relative to the watercraft operator will activate the trim and tilt mechanism to cause the tilt-up (trim-up) or the tilt-down (trim-down) motion of the outboard motor. For instance, when the hand control lever 5 is tilted forward (in the direction of arrow "S"), the trim and tilt mechanism is activated to lower the outboard motor ("Down" operation). When the hand control lever 5 is tilted rearward (in the direction of arrow "B"), the trim and tilt mechanism is activated to raise the outboard motor ("UP" operation). In this way, the provision of outboard motor trim and tilt control feature on the hand control lever 5 enables the watercraft operators to control the outboard motor trim and tilt mechanism without the need for reaching out their hands to the position away from the steering wheel 6.

As used herein, "trim" means the action to adjust the trim angle while the watercraft 1 is under way. The trim angle means the inclination of outboard motor to the fore or to the aft. "Tilt" means the action to lift up the outboard motor to prevent the propeller from hitting the sea bed when, for instance, when the watercraft 1 is getting the shore. Both trim and tilt actions are performed by turning the entire outboard motor unit around the tilt axis utilizing the hydraulic cylinder provided on the clamp bracket. The selection switch on the end portion 5*a*, as described above (FIG. 6) may be used for switching the trim action and the tilt action. Otherwise, the selection switch may be provided in other area.

Figure 9:
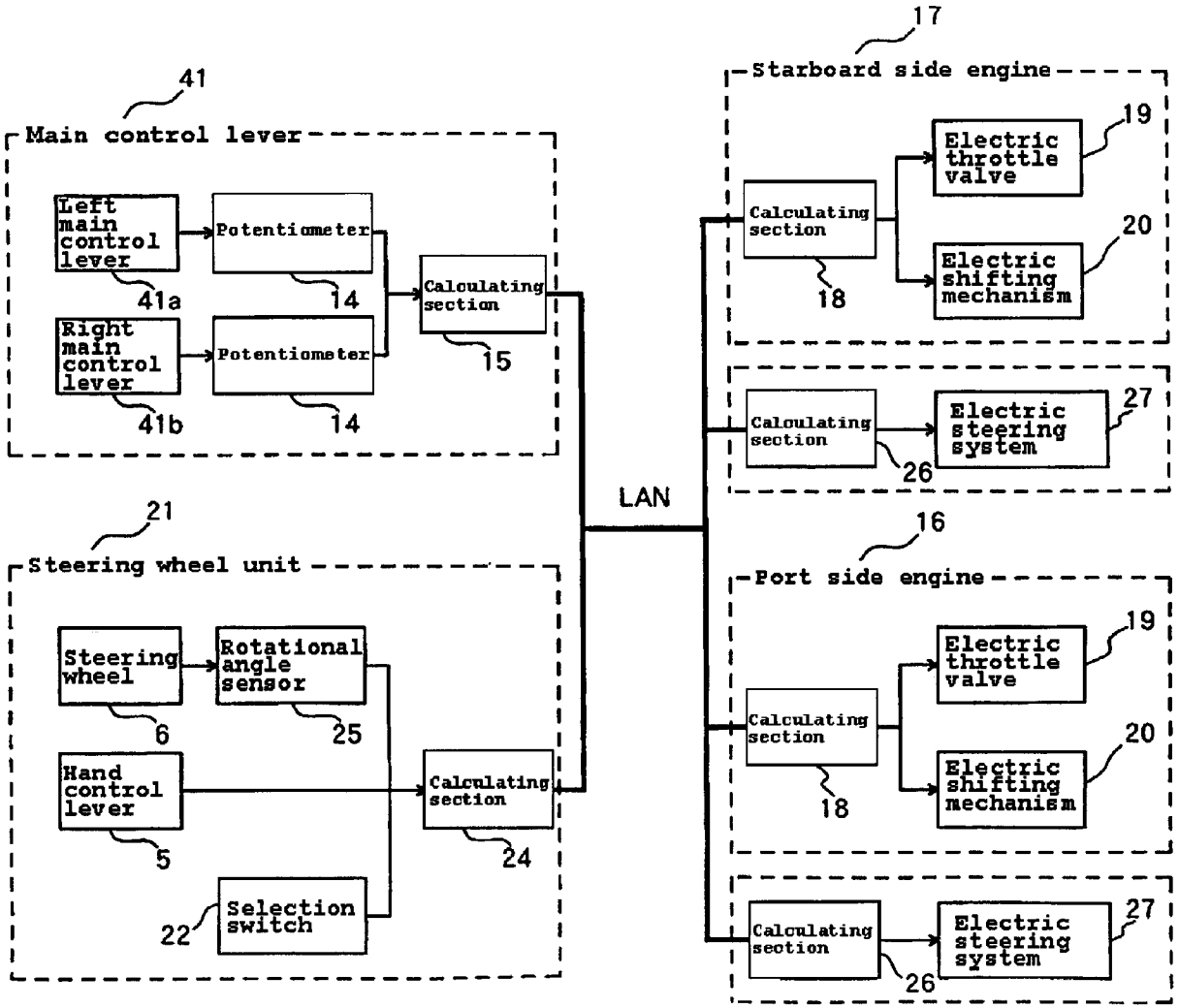
FIG. 9 is an illustrative block diagram of a circuit in the watercraft having the marine steering wheel according to this invention.
Figure 10:
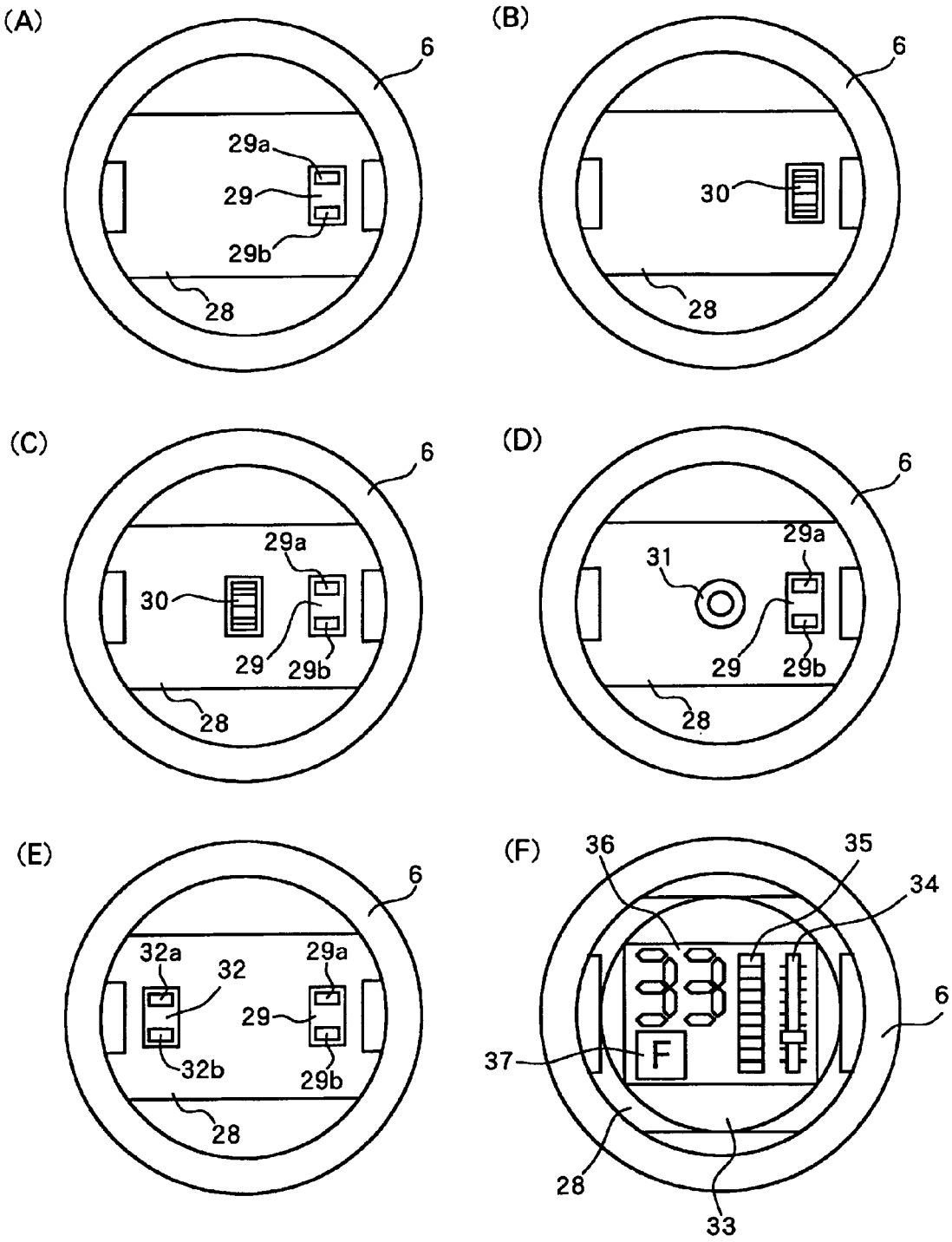
FIG. 10 is the schematic views to show other examples of watercraft steering wheel according to this invention.

FIG. 9 is an illustrative block diagram of a circuit in the watercraft having the steering wheel according to an embodiment with a twin outboard motor, as a non-limiting example. The main control lever mechanism 41 a lever with a grip can be mounted at the side of the operator's seat. The main control lever mechanism 41 in this embodiment includes control levers 41*a* and 41*b* on the left and on the right for adjusting the throttle openings of the port side engine and the starboard side engine respectively.

A potentiometer 14 can be connected to the left and the right main control levers 41*a* and 41*b* for detecting the positions of each control lever 41*a*, 41*b*. The positional information regarding the left and the right main control levers 41*a* and 41*b* detected by the potentiometer 14 can be transmitted by a calculating section 15 to the calculating sections 18 in the port side engine 16 and the starboard side engine 17 by way of LAN.

As described above, the left and the right main control levers 41*a* and 41*b* work for shifting and acceleration control of each engine. The transmission is in neutral when the levers 41*a*, 41*b* are in their center position. The transmission is shifted into forward when the levers 41*a*, 41*b* are tilted forward, and is shifted into reverse when the levers 41*a* 41*b* are tilted rearwardly.

After the transmission is shifted into forward, and when the levers 41*a* 41*b* are tilted further forward, the throttle valves open until they reach to the full open throttle position. After the transmission is shifted into reverse, and when the levers 41*a* 41*b* are further leaned rearwardly, the wider the throttle valves open until they reach to the full open throttle position. In this way, the engine acceleration is achieved by controlling the opening and closing motions of the throttle valves in both forward and reverse operations.

As described above, the position of each main control lever 41*a* and 41*b* determines the gear shift positions; forward, reverse, or neutral, as well as the throttle valve opening. Each potentiometer 14 detects the positions of the main control levers 41*a* and 41*b* provided on the left and on the right respectively. Thus, the detected positional information for each control lever allows the computation of gear shift position and the throttle opening of the engine mounted in each outboard motor. Based on the positional information for each control lever 41*a* and 41*b* received from the calculating section 15 on the control lever, the calculating sections 18 in the port side and starboard side engines 16 and 17 calculate the gear shift position and the throttle opening of each engine.

Shift command signals and throttle opening command signals can be transmitted based on the calculated gear shift position and throttle opening. The shift command signals activate the clutch (not shown) by way of the driving system (not shown) for an electric shifting mechanism 20 to shift the gear into forward, reverse, or into neutral. Also, the throttle opening command signal drives the motor (not shown) connected to the throttle valve (not shown) in an electric throttle 19 to adjust the throttle valve to the specified throttle opening.

In the meantime, the operations using the hand control lever 5 mounted on the steering wheel 21 are transmitted by the calculating section 24 through LAN to the port side and the starboard side engines 16 and 17, as is the case with the left and the right main control levers 41*a* and 41*b* described above. As have been described for each embodiment (FIG. 2 through FIG. 8), the signals transmitted in response to the motions of hand control lever 5 determine the throttle openings. Further, in the case of the example shown in FIG. 4, the gear shift position is determined in addition to the throttle opening. For the throttle valve opening adjustment, either the main control lever 41 or the hand control lever 5 shall be selected by means of the selection switch 22 in any case.

One of the levers not selected shall be invalidated. The operational signals are input by the selected lever to the arithmetic area 18 in the engine, and the electric throttle valve 19 is driven accordingly.

For the gear shift operations in the example shown in FIG. 4, either the main control lever 41 or the hand control lever 5 shall be selected by means of the selection switch 22, simultaneously with the control lever selection for the throttle opening adjustment. In other examples, the gear shift position is changed by driving the electric shifting mechanism 20 in accordance with the signal transmitted by the main control lever. The selection switch 22 is used only for selecting either the main control lever 41 or the hand control lever 5 to adjust the throttle valve opening. The selection switch 22 is provided, for instance, at the end portion 5*a* of the hand control lever 5 as shown in FIG. 6 above.

As for the operations by the steering wheel 6, the steering torque can be computed at the calculating section 24 based on the detected signal from the rotational angle sensor 25. Then, the information is transmitted to the calculating sections 26 on each engine 16, 17 in the form of electric command signal. The calculating sections 26 on the engines drive the electric steering system 27 in accordance with the torque on the steering wheel, and the watercraft is practically steered. The driving command signal for the electric steering system 27 can be computed by the calculating section 26 on the engines.

FIG. 10(A) through (F) are schematic views showing other non-limiting examples of watercraft steering wheel according to an embodiment. Each embodiment shown in FIG. 1 through FIG. 9 above has the hand control lever on the steering wheel shaft. On the other hand, the examples shown in FIG. 10 have a push-button type or dial type operating device on the top face of the steering wheel (that is, the surface facing the watercraft operator), in place of the hand control lever described above. Therefore, every operating device provided on the top face of the steering wheel in these examples has basically the similar functions as the examples of the above-mentioned hand control lever. Further, the examples shown in FIG. 10 can be connected to other mechanisms in the same manner as described above, and are capable of operating in cooperation with such mechanisms. Other structures and functions regarding the watercraft body and the outboard motor are equivalent to those on which the hand control lever described above is applied.

FIG. 10(A) shows an example having a push-button type control switch 29 on a front face plate 28 forming the top face of the steering wheel 6. The control switch 29 has vertically aligned buttons 29*a* and 29*b*. Pressing the upper button 29*a* causes opening motion of the throttle valve, while pressing the lower button 29*b* causes its closing motion. The throttle valve continues its opening motion as far as the upper button 29*a* is being pressed. It stops the opening motion once the upper button 29*a* is released. Pressing the lower button 29*b* starts the closing motion of the throttle valve. The throttle valve continues its closing motion as far as the lower button 29*b* is being pressed. It stops as the operator's finger is removed from the button. This means the example (A) has the control mechanism equivalent to the up and down operation of the hand control lever 5 in FIG. 2 described above.

With this arrangement, operators are still able to adjust the throttle opening with both of their hands being kept on the steering wheel. These push-buttons 29*a* and 29*b* can be joined to the shifting mechanism so that they can change the gear shift as is the case with the example in FIG. 4 above.

For example, pressing the upper button 29*a* cause the gear shift into forward. As the upper button 29*a* is kept pressed, the throttle valve gradually opens in the forward gear until it reaches to the full open throttle position. Whenever the upper button 29*a* is released on the way, the throttle valve opening at that time is sustained. The throttle valve starts to close as the lower button 29*b* is pressed. By continuously pressing the lower button 29*b*, the throttle valve keeps closing until it reaches to the fully-closed position. Pressing the lower button further across the fully-closed position, the gear is shifted into reverse. As it is kept pressed, the throttle valve gradually opens in the reverse gear until it reaches to the full open throttle position. Whenever the upper button 29*a* is released on the way, the throttle valve opening at the time is sustained. Further, the examples in FIG. 10(A) described so far can be applied to the outboard motor multiple installation as is the case with the example in FIG.

7, to control the throttle valve opening of multiple outboard motors using one common control switch 29.

FIG. 10(B) shows an example having a rotatable control dial 30 on the front face plate 28 of the steering wheel 6. The opening and closing operation of the throttle valve using the control dial 30 is similar to the example shown in FIG. 3 above. The throttle valve opens in response to the rotational angle of the dial 30. In other words, similar to the throttle control in FIG. 3 using the dial provided at the end of hand control lever, the position of the dial corresponds to the throttle valve opening. By fixedly allocating the dial scale to the throttle valve openings from fully-closed position (at idle) to fully-opened position (full open throttle), the throttle valve opening can be controlled by adjusting the dial's rotational position with its scale.

FIG. 10(C) shows an example provided with variable throttle opening speed functionality, similar to the example in FIG. 5 above. Similar to the example in FIG. 10(A), the example (C) has a push-button type control switch 29 for activating the throttle valve opening and closing motions. In addition, the throttle valve opening and closing speed adjustment dial 30 is provided next to the control switch 29. The control switch 29 drives the throttle valve in opening or closing direction for adjusting the throttle valve opening, while the speed of such operation is controlled with the speed adjustment dial 30.

FIG. 10(D) shows an example provided with a selection switch 31 on the front face plate 28 to choose either the main control lever or the control switch 29. This arrangement is similar to the example in FIG. 6 above. The watercraft operator can switch the throttle valve opening control means between the main control lever (not shown) located at the side of the operator's seat, and the control switch 29 on the steering wheel depending on the circumstances.

FIG. 10(E) shows an example that applies a push-button type control switch 32 in conjunction with the control switch 29 of similar type. One control switch 29 activates the throttle valve opening and closing operation as is the case with the example in FIG. 10(A), and the other control switch 32 activates the outboard motor's trim and tilt operation. For instance, it may be configured that the outboard motor will tilt up by pressing an upper button 32*a* of the control switch 32, and that the outboard motor will tilt down by pressing a lower button 32*b*.

FIG. 10(F) shows an example having a touch-panel type liquid crystal display 33 on the front face plate 28 of the steering wheel 6. The liquid crystal display 33 can be rotatable relative to the steering wheel 6, and is kept at the fixed display position to the watercraft operator regardless of the turning motion of the steering wheel. The throttle valve opening can be adjusted by touching the throttle valve opening control portion 34 on the display with a fingertip. Trim angle is shown in the trim display portion 35. The liquid crystal display 33 includes an engine speed display portion 36 and a gear shift display portion 37.

The present inventions are applicable to small watercraft having marine propulsion units. The marine propulsion units to which these inventions can be applied include an outboard motor in which the engine as well as the propulsion system such as a propeller are mounted outside of the watercraft, and a stern drive unit in which the engine is mounted inside the watercraft while the propulsion system such as the propeller is mounted outside of the watercraft.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A watercraft comprising a steering unit including a steering wheel and a steering wheel shaft, a watercraft propulsion system mounted at a stem of the watercraft, the propulsion system comprising at least first and second engines driving first and second propulsion units, respectively, first and second intake air amount control mechanisms configured to control the amount of air taken into the first and second engines, respectively, a first manually operated intake air amount adjusting means disposed in the vicinity of the steering wheel, and a second manually operated intake air amount adjusting means comprising a single control arrangement for adjusting the operation of the first and second intake air amount control mechanisms, wherein the second intake air amount adjusting means is mounted on the steering wheel unit.

2. The watercraft according to claim 1, wherein the intake air amount control mechanisms comprise electric throttle valves.

3. The watercraft according to claim 1, wherein the second intake air amount adjusting means is constituted with a stick-shaped hand control lever attached to the steering wheel shaft.

4. A watercraft comprising a steering unit including a steering wheel and a steering wheel shaft, a watercraft propulsion system mounted at a stem of the watercraft, an intake air amount control mechanism for controlling the amount of air taken into an engine driving the watercraft propulsion system, and a manually operated intake air amount adjusting means for adjusting the operation of the intake air amount control mechanism, wherein the intake air amount adjusting means is mounted on the steering wheel unit, wherein the intake air amount adjusting means is constituted with at least one of a push-button type and a rotatable-dial type operating device attached to a surface of the steering wheel facing a watercraft operator.

5. The watercraft according to claim 1 additionally comprising a gear shift mechanism that is configured to be activated by the second intake air amount adjusting means.

6. The watercraft according to claim 1, wherein the second intake air amount adjusting means includes means for increasing or decreasing speed of changes to intake air amount.

7. A watercraft comprising a steering unit including a steering wheel and a steering wheel shaft, a watercraft propulsion system mounted at a stem of the watercraft, an intake air amount control mechanism for controlling the amount of air taken into an engine driving the watercraft propulsion system, a manually operated intake air amount adjusting means for adjusting the operation of the intake air amount control mechanism, wherein the intake air amount adjusting means is mounted on the steering wheel unit, and a main control lever configured for manually operating the intake air amount control mechanism provided at a different location from the steering wheel, and a selection switch configured for selective activation of the main control lever or the intake air amount adjusting means, the selection switch being provided on the steering wheel unit.

8. The watercraft according to claim 1, wherein the second intake air amount adjusting means comprising a single manually operable member.

9. A watercraft comprising a steering unit including a steering wheel and a steering wheel shaft, a watercraft propulsion system mounted at a stem of the watercraft, an intake air amount control mechanism for controlling the amount of air taken into an engine driving the watercraft propulsion system, and a manually operated intake air amount adjusting means for adjusting the operation of the intake air amount control mechanism, wherein the intake air amount adjusting means is mounted on the steering wheel unit, wherein the intake air amount adjusting means includes means for trim and tilt control for the watercraft propulsion system.

10. A watercraft comprising a steering unit including a steering wheel and a steering wheel shaft, a watercraft propulsion system mounted at a stem of the watercraft, an intake air amount control mechanism for controlling the amount of air taken into an engine driving the watercraft propulsion system, and a manually operated intake air amount adjusting means for adjusting the operation of the intake air amount control mechanism, wherein the intake air amount adjusting means is mounted on the steering wheel unit, wherein operating conditions including engine speed are displayed on a font face surface of the steering wheel facing the watercraft operator.

11. A watercraft comprising a steering unit including a steering wheel and a steering wheel shaft, a watercraft propulsion system mounted at a stem of the watercraft, the propulsion system comprising at least first and second engines driving first and second propulsion units, respectively, first and second power output control mechanisms configured to control the power output of first and second engines, respectively, a first manually operated power output adjustment device configured to adjust the operation of the power output control mechanisms spaced from the steering wheel unit, and a second manually operated power output adjustment device including a single input device configured to adjust the operation of the power output control mechanisms, wherein the second power output adjusting device is mounted on the steering unit.

12. The watercraft according to claim 11, wherein the power output control mechanisms comprise throttle valves configured to control an intake air amount into the engine.

13. The watercraft according to claim 11, wherein the second manually operated power output adjustment device comprises a lever.

14. The watercraft according to claim 11 additionally comprising a local area network connecting the second manually operated power output adjustment device with the first and second power output control mechanisms.

15. The watercraft according to claim 11, wherein the second manually operated power output adjustment device comprises only a single switch assembly having only one power increase button and only one power decrease button.

16. The watercraft according to claim 11, wherein the second manually operated power output adjustment device comprises a member mounted in the center of the steering wheel and is configured to remain stationary when the steering wheel is rotated.

17. The watercraft according to claim 1 additionally comprising a local area network connecting the second manually operated intake air amount adjusting means with the first and second intake air amount control mechanisms.

18. The watercraft according to claim 1, wherein the second manually operated intake air amount adjusting means comprises only a single switch assembly having only one power increase button and only one power decrease button.

19. The watercraft according to claim 1, wherein the second manually operated intake air amount adjusting means comprises a member mounted in the center of the steering wheel and is configured to remain stationary when the steering wheel is rotated.

* * * * *

UNITED STATES PATENT AND TRADEMARK OFFICE

CERTIFICATE OF CORRECTION

PATENT NO. : 7,306,499 B2
APPLICATION NO. : 11/135959
DATED : December 11, 2007
INVENTOR(S) : Takashi Okuyama It is certified that error appears in the above-identified patent and that said Letters Patent is hereby corrected as shown below:

At column 1, line 14, please delete “stem” and insert -- stern --, therefor.

At column 1, line 19, please delete “stem” and insert -- stern --, therefor.

At column 2, line 33, please delete “stem” and insert -- stern --, therefor.

At column 2, line 44, please delete “stem” and insert -- stern --, therefor.

At column 2, line 55, please delete “stem” and insert -- stern --, therefor.

At column 14, line 20, in Claim 1, please delete “stem” and insert -- stern --, therefor.

At column 14, line 42, in Claim 4, please delete “stem” and insert -- stern --, therefor.

At column 14, line 62, in Claim 7, please delete “stem” and insert -- stern --, therefor.

At column 15, line 13, in Claim 9, please delete “stem” and insert -- stern --, therefor.

At column 15, line 25, in Claim 10, please delete “stem” and insert -- stern --, therefor.

At column 15, line 37, in Claim 11, please delete “stem” and insert -- stern --, therefor.

Signed and Sealed this

Eighteenth Day of November, 2008

JON W. DUDAS
*Director of the United States Patent and Trademark Office*